US012404733B2

(12) United States Patent
Rapp

(10) Patent No.: US 12,404,733 B2
(45) Date of Patent: Sep. 2, 2025

(54) DROP TOOL IMPACT SHOCK MITIGATION WITH FLUID RETENTION METHOD AND SYSTEM

(71) Applicant: Scientific Drilling International, Inc., Houston, TX (US)

(72) Inventor: Jason Rapp, Norman, OK (US)

(73) Assignee: Scientific Drilling International, Inc., Houston, TX (US)

( * ) Notice: Subject to any disclaimer, the term of this patent is extended or adjusted under 35 U.S.C. 154(b) by 0 days.

(21) Appl. No.: 18/796,879

(22) Filed: Aug. 7, 2024

(65) Prior Publication Data

US 2025/0109645 A1 Apr. 3, 2025

Related U.S. Application Data

(60) Provisional application No. 63/542,238, filed on Oct. 3, 2023.

(51) Int. Cl.

| | |
|---|---|
| ***E21B 23/10*** | (2006.01) |
| ***E21B 33/12*** | (2006.01) |
| ***E21B 47/00*** | (2012.01) |

(52) U.S. Cl.

CPC ..... *E21B 23/10* (2013.01); *E21B 33/12* (2013.01); *E21B 47/00* (2013.01)

(58) Field of Classification Search

CPC ..... E21B 23/10; E21B 33/12; E21B 47/00; E21B 23/08; E21B 34/142

See application file for complete search history.

(56) References Cited

U.S. PATENT DOCUMENTS

| | | | | | |
|---|---|---|---|---|---|
| 4,047,566 | A * | 9/1977 | Duke | E21B 33/076 | 166/155 |
| 4,392,527 | A * | 7/1983 | Hauk | E21B 43/112 | 175/269 |
| 4,577,702 | A * | 3/1986 | Faulkner | E21B 21/00 | 166/373 |
| 4,932,471 | A * | 6/1990 | Tucker | E21B 23/10 | 267/125 |
| 5,474,128 | A * | 12/1995 | Bitting | E21B 43/38 | 166/242.7 |
| 5,915,478 | A * | 6/1999 | Brown | E21B 34/08 | 166/372 |
| 6,209,391 | B1 * | 4/2001 | Dallas | E21B 47/017 | 175/50 |
| RE42,877 | E * | 11/2011 | Lirette | E21B 33/14 | 175/57 |
| 9,033,038 | B2 * | 5/2015 | Hetz | E21B 47/16 | 166/250.17 |
| 9,404,330 | B2 * | 8/2016 | Speer | E21B 34/142 | |

(Continued)

*Primary Examiner* — Steven A MacDonald
(74) *Attorney, Agent, or Firm* — Ewing & Jones, PLLC

(57) ABSTRACT

Methods and systems provide for landing a tool downhole in a tool dropping operation. In situations where loss of fluid introduced into a tubular string occurs resulting in an interior volume of the tubular string becoming dry or gaseous, a plug is seated in the tubular string and the tubular string is filled with a liquid before the tool is lowered through the tubular string in the tool dropping operation. The tool travels safely through the liquid and lands at a profile above the plug. Thereafter, the plug may be unseated and caught lower within the tubular string to enable reestablishing flow from inside to outside of the tubular string.

19 Claims, 5 Drawing Sheets

(56) References Cited

U.S. PATENT DOCUMENTS

2004/0163820 A1* 8/2004 Bishop ..... E21B 34/142 166/373
2006/0102348 A1* 5/2006 Churchill ..... E21B 23/08 166/113
2009/0159297 A1* 6/2009 Fould ..... E21B 23/04 166/387
2009/0266659 A1* 10/2009 Lembcke ..... F16F 9/3235 188/268
2011/0030947 A1* 2/2011 Schreiber ..... E21B 33/138 166/250.01
2011/0240315 A1* 10/2011 McNeilly ..... E21B 34/14 166/386
2011/0259603 A1* 10/2011 Kent ..... E21B 34/142 166/380
2012/0073827 A1* 3/2012 Kenyon ..... E21B 34/107 166/373
2012/0227973 A1* 9/2012 Hart ..... E21B 21/103 166/329
2012/0292030 A1* 11/2012 Xu ..... E21B 43/27 166/308.1
2013/0000926 A1* 1/2013 Parrott ..... E21B 34/142 166/321
2013/0025868 A1* 1/2013 Smith ..... E21B 34/142 166/308.1
2015/0075816 A1* 3/2015 Jacob ..... E21B 23/00 166/387
2015/0308229 A1* 10/2015 Patton ..... E21B 33/12 166/185
2016/0017700 A1* 1/2016 Roycroft ..... E21B 23/08 166/105
2016/0160603 A1* 6/2016 Sevadjian ..... E21B 33/14 166/288
2016/0168963 A1* 6/2016 Roycroft ..... E21B 43/121 166/105
2016/0215600 A1* 7/2016 Roycroft ..... E21B 43/121
2016/0281459 A1* 9/2016 Stautzenberger ..... E21B 33/04
2016/0290087 A1* 10/2016 Cherewyk ..... E21B 33/05
2017/0204703 A1* 7/2017 Mair ..... E21B 23/14
2021/0131225 A1* 5/2021 Churchill ..... E21B 21/10
2023/0074077 A1* 3/2023 Dunlop ..... E21B 7/20
2025/0109645 A1* 4/2025 Rapp ..... E21B 34/142

* cited by examiner

DROP TOOL IMPACT SHOCK MITIGATION WITH FLUID RETENTION METHOD AND SYSTEM

CROSS-REFERENCE TO RELATED APPLICATIONS

This application is a nonprovisional application which claims priority from U.S. provisional application No. 63/542,238, filed Oct. 3, 2023, which is incorporated by reference herein in its entirety.

TECHNICAL FIELD/FIELD OF THE DISCLOSURE

The present disclosure relates generally to systems and methods to deploy tools by dropping into a well.

BACKGROUND OF THE DISCLOSURE

Different techniques convey various tools into hydrocarbon wells with the technique selected based on factors including application of the tool and characteristics of the well. While in some instances the tool may run in the well on wireline or within a tubing string, other times a desired and convenient approach relies on dropping the tool into the well without a physical supporting connection back to surface. Types of tools deployed by being dropped may include measuring or logging devices, such as tools for gyro surveying, Passing the tool once dropped through inside of a drill string, for example, may rely on fluid in the drill string to help slow descent of the tool for accurate measurements and for ensuring the tool is not damaged upon landing at a target downhole location. However, the interior volume of the drill string can become dry or gaseous in instances where liquid-based fluid being introduced through the drill string is lost to a surrounding formation. Inability to maintain the liquid-based fluid within the drill string thereby limits options for safely deploying the tool into the well.

SUMMARY

The present disclosure provides for systems and methods to drop a tool into a well.

In one embodiment, a method of landing a tool downhole in a tool dropping operation includes running into a wellbore a tubular string, which has a seat defining a first restriction in an inner diameter of the tubular string and a landing profile defining a second restriction in the inner diameter of the tubular string above the seat. The method further includes dropping a plug into the tubular string and onto the seat to block fluid flow through the seat and filling the tubular string above the plug on the seat with a liquid-based fluid. Passing the tool in the tool dropping operation through the fluid occurs until an outward extending landing element of the tool is retained at the landing profile.

For one embodiment, tool deployment system for a tool dropping operation to land a tool downhole includes a tubular string disposed in a wellbore, a seat defining a first restriction in an inner diameter of the tubular string, and a plug retainable by the seat to block fluid flow through the seat. A landing profile defines a second restriction in the inner diameter of the tubular string above the seat. Tool deployment system also includes an outward extending landing element of the tool for retention of the tool at the landing profile as the tool travels through the tubular string in the tool dropping operation.

According to one embodiment, a method of landing a measuring device downhole in a tool dropping operation includes drilling a wellbore with a drill string having a bit at a distal end of the drill string and inside the drill string having a seat and a landing profile above the seat. In addition, the method includes dropping a ball onto the seat to block fluid flow past the seat, filling the drill string above the ball on the seat with a liquid-based fluid, passing the measuring device in the tool dropping operation through the fluid until a landing cone of the measuring device is caught at the landing profile, and logging the wellbore with the measuring device. The method then includes pushing the ball through the seat by increasing fluid pressure above the ball, catching the ball at a location in the drill string above the bit after the ball is pushed through the seat, and establishing flow of the fluid from the drill string above the location with the ball to out of the drill string exiting below the location with the ball.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
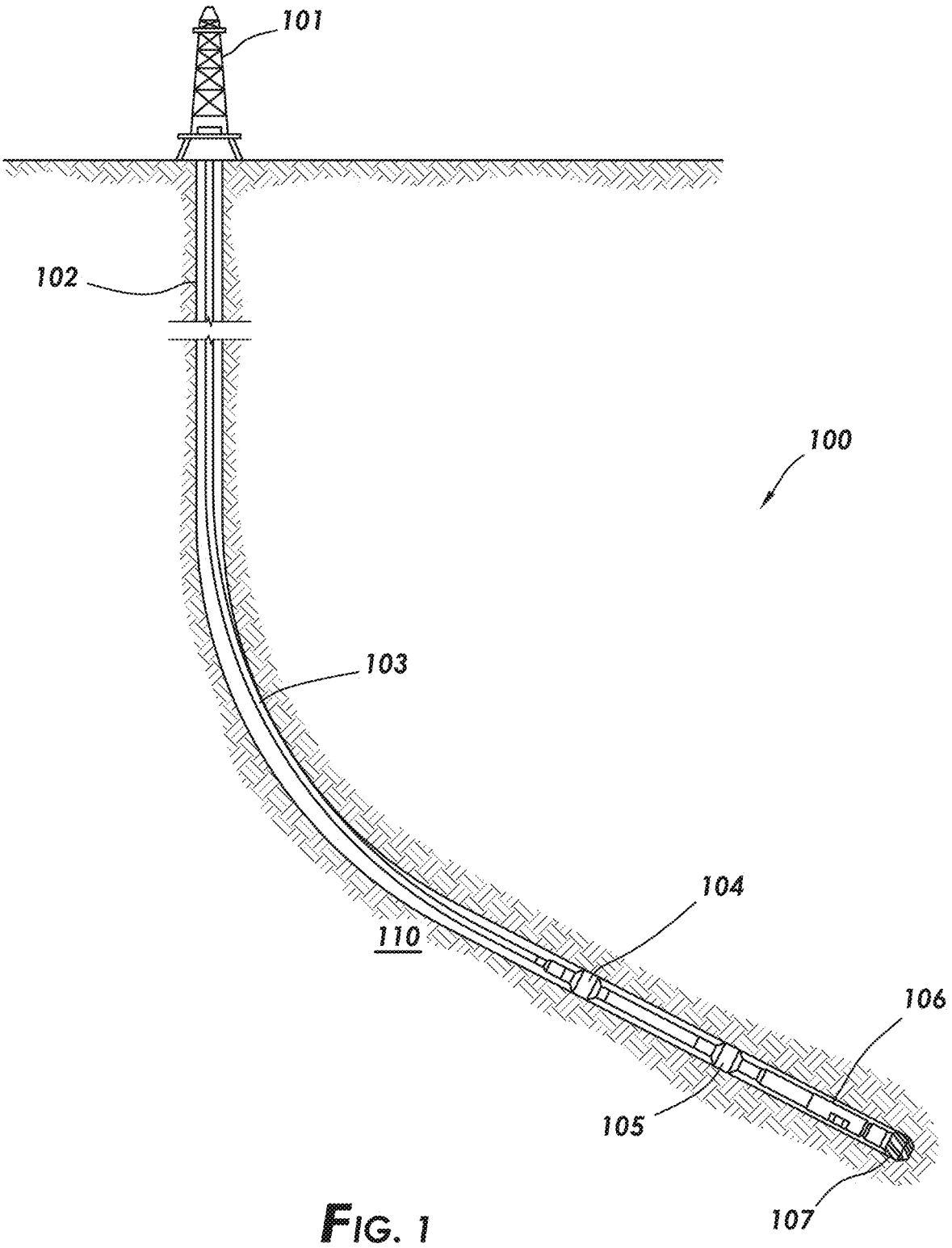
FIG. 1 is a schematic view of a well with tool deployment system along a drill string, in accordance with one embodiment.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts tool deployment system 100 used with a rig 101 and within a wellbore 102 drilled into a subterranean formation 110. A wellbore tubular, such as coiled tubing, casing, liner or drill string 103, includes a landing sub 104 disposed above a catch sub 105 of tool deployment system 100. The landing and catch subs 104, 105 may integrate in some embodiments as either separate or combined components along the drill string 103 through standard pin and box connections or for some embodiments be features integrated directly with sections, joints or connectors of the drill string 103. The drill string 103 further includes typical components for drilling of the wellbore 102 below the landing and catch subs 104, 105 and thus terminates at a distal end with a bottom hole assembly 106 ahead of a drill bit 107. While often desired for the landing sub 104 to be located proximate the bottom hole assembly 106 as shown, the location of the landing sub 104 may vary based on a desired target downhole location for conducting a downhole operation or well logging, for example. In operation while drilling the wellbore 102, drilling fluid pumped via the rig 101 flows through the drill string 103 and exits proximate the drill bit 107 to carry cuttings back to surface.

Sometimes the drilling fluid introduced into the drill string 103 escapes into the formation 110 thereby limiting ability to maintain the drilling fluid or any other liquid-based fluids within the drill string 103 for tool dropping operations into the drill string 103. As used herein, tool dropping operations refers to when any downhole device or tool is introduced into a wellbore conduit or tubular without being lowered by a physical connection or tether back to surface but is rather allowed to pass through the downhole tubular in an unattached manner. The interior volume of the drill string 103 can thus become dry or gaseous. However, tool deployment system 100 enables establishing a liquid-based fluid column inside the drill string 103 to facilitate tool dropping operations by using the fluid column for slowing tool descent and reducing risk of tool damage upon landing at a target downhole location.

Figure 2:
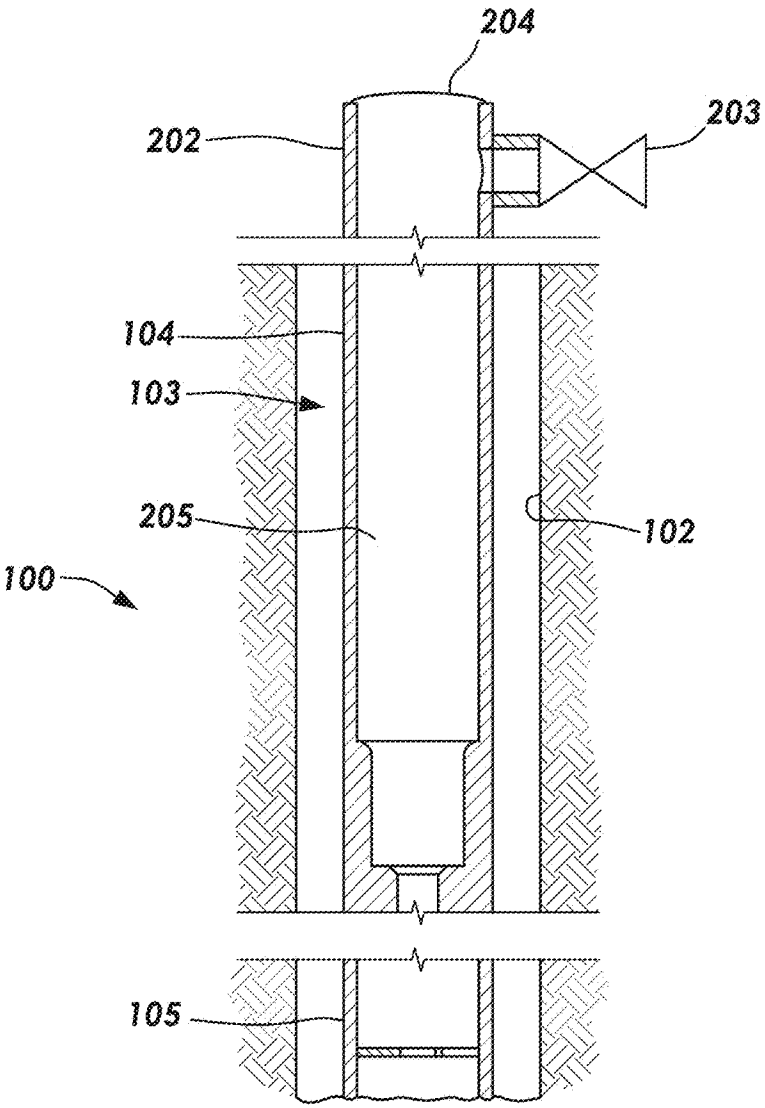
FIG. 2 is a cross-sectional view of a surface sub, landing sub and catch sub of tool deployment system in the well in a run-in state, according to one embodiment.

FIG. 2 with reference to FIG. 1 shows further details of tool deployment system 100 including a surface sub 202 located at the rig 101 and in fluid communication with the landing and catch subs 104, 105 in the wellbore 102. For some embodiments, the surface sub 202 is placed between a top drive of the rig 101 and the drill string 103. The surface sub 202 during the drilling and/or survey/logging directs the drilling fluid received at an input end 204 of the surface sub 202 into the drill string 103 with a bypass valve 203 of the surface sub 202 remaining closed. In a run-in state of tool deployment system 100 as in FIG. 2, an open interior area 205 passing through the landing sub 104 remains unobstructed providing a through passageway for flow of the drilling fluid in the drill string 103 from the rig 101 to the drill bit 107. The landing and catch subs 104, 105 lower into the wellbore 102 as the drill string 103 progresses deeper without tool deployment system 100 inhibiting fluid flow used for drilling being done with the bottom hole assembly 106 and drill bit 107.

Figure 3:
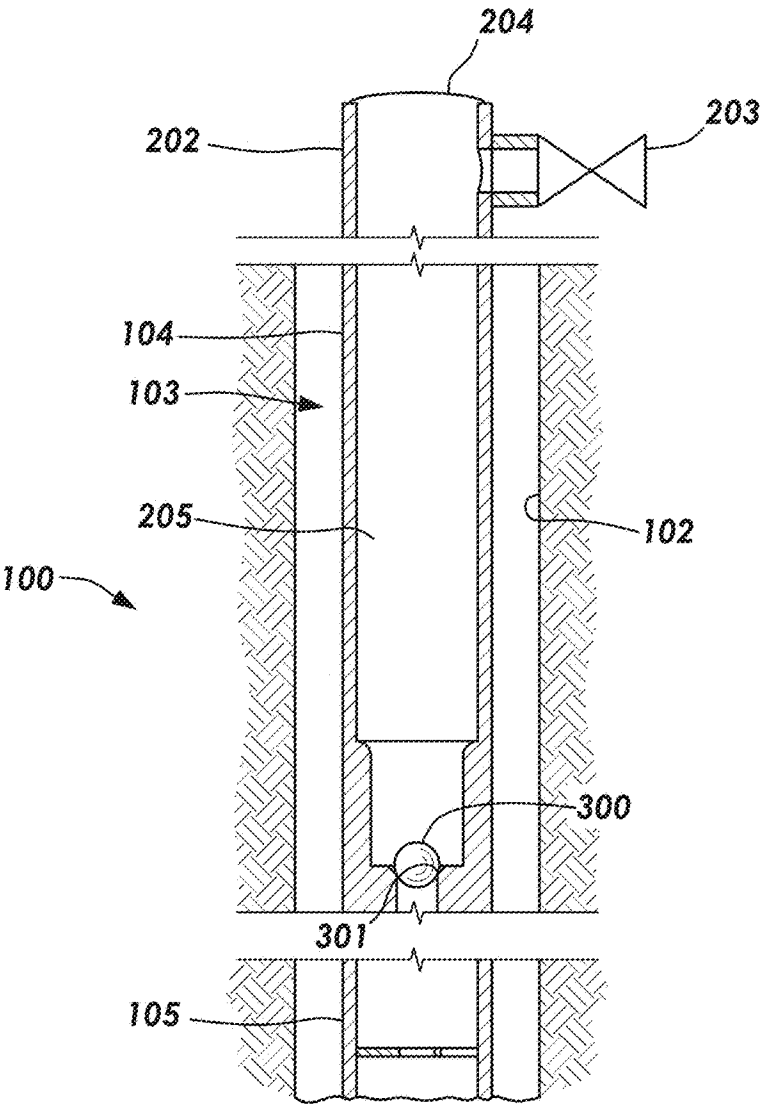
FIG. 3 is a cross-sectional view of the landing sub in a blocked state after seating an obstruction to prevent fluid exiting the drill string.

FIG. 3 illustrates a blocked state of tool deployment system 100 when desired to initiate the tool dropping operation. An obstruction, such as a plug or ball 300 introduced into the drill string 103 from surface travels down the drill string 103 and blocks a flowpath through the interior area 205 of the landing sub 104 because of the ball 300 being retained in a seat 301 formed by a first restriction in an inner diameter of the landing sub 104 sized smaller than the ball 300. The ball 300 thereby prevents fluid exiting the drill string 103 below the seat 301 at normal outlets proximate the drill bit 107.

The ball 300 and the seat 301 arrangement may include any features capable of providing temporary flowpath sealing as desired. In some embodiments, the sealing is temporary based on amount of fluid pressure above the ball 300 in the interior area 205 of the landing sub 104. At a threshold pressure, the ball 300 may be forced through the seat 301. Other examples for the temporary sealing include making the ball 300 frangible for disassembly at the threshold pressure or upon landing of a tool (shown in FIG. 4) into contact with the ball 300, making the ball 300 dissolvable with introduction of a dissolving agent or including a shearable element in the seat 301 for disassembly or release of the seat 301 at the threshold pressure.

With the ball 300 on the seat 301, the drilling fluid or any other liquid-based fluid used during the tool dropping operation flows through the surface sub 202 and is directed into the drill string 103 until the interior area 205 is filled with the drilling fluid as high in the drill string 103 as desired. The surface sub 202 couples to a surface reservoir or tank when the bypass valve 203 is open to provide selective fluid communication with the tank. Operation of the bypass valve 203 as a relief for pressure ensures diverting the drilling fluid through the bypass valve 203 to the tank instead of the drill string 103 before the threshold pressure is reached.

Figure 4:
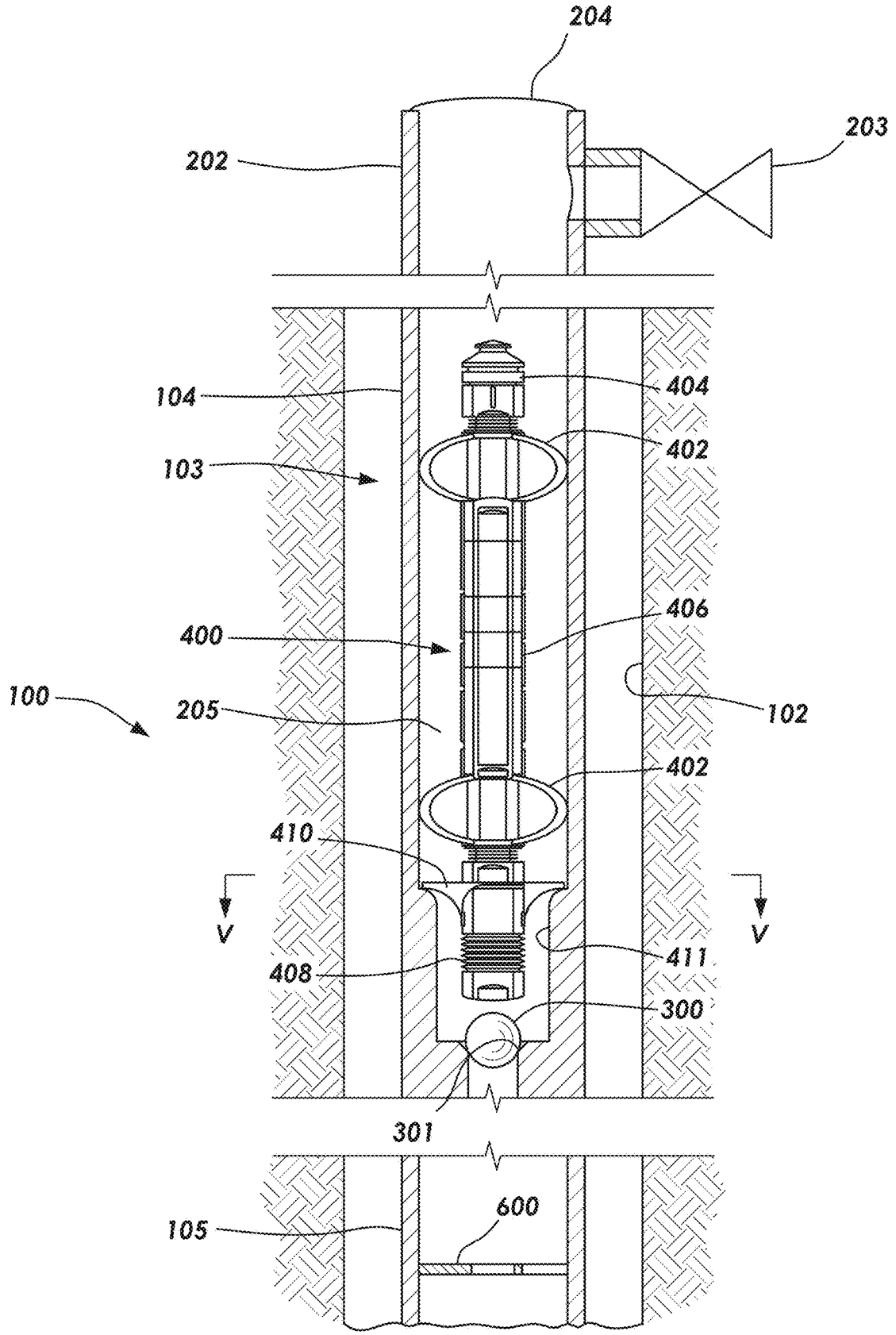
FIG. 4 is a partial cross-sectional view of a tool having been received by the landing sub in a deployed state.

FIG. 4 depicts the tool 400 received by the landing sub 104 in a deployed state of tool deployment system 100. The tool 400 drops safely in the tool dropping operation through the drill string 103 before reaching the landing sub 104 since the drill string 103 is filled with the drilling fluid. A landing profile 411 defines a second restriction in the inner diameter of the landing sub 104 sized to prevent further passage of an outward extending landing element, such as a landing cone 410 disposed around the tool 400. The first restriction in the inner diameter of the landing sub 104 at the seat 301 being relatively smaller than the second restriction at the landing profile 411 permits the landing profile 411 to be of sufficient diameter for the ball 300 to pass through the landing profile 411 disposed above the seat 301. Selectable different outside diameter sizes of the landing cone 410 provides interchangeability of the landing cone 410 based on the inner diameter of the drill string 103 without requiring further changes to the tool 400. The landing cone 410 tapers downward in a mating relationship to an upwardly increasing inside diameter of the landing profile 411. In some embodiments, the tool 400 further includes centralizing elements 402 to aid in maintaining the tool centered in the drill string 103. The tool 400 may include a spear 404 at a top end of the tool 400 for engagement with a fishing device for optional retrieval of the tool 400.

A sensing section 406, included for some embodiments of the tool 400, may include various measurement and/or source emitting equipment for detecting properties of the formation 110, the drill string 103 and/or fluids in or around the wellbore 102 to provide well logging. The properties of the formation 110 may include inclination, azimuth and wellbore diameter. As an example, the sensing section 406 of the tool 400 may include any of a power source, processors, memory, telemetry and sensors, such as a gyro. Other embodiments of the sensing section 406 of the tool 400 may provide resistivity sensing, nuclear magnetic resonance (NMR) sensing, pulsed neutron logging, neutron porosity sensing using chemical neutron sources, cased hole resistivity sensing or acoustic sensing. To further help protect sensitive components in the sensing section 406 even though the tool 400 is not being dropped with the drill string 103 unfilled, a bottom end of the tool 400 for some embodiments includes a shock 408 that may be coupled to the landing cone 410 to absorb energy associated with mating of the tool 400 to the landing profile 411 or otherwise adapted to dissipate any potential impact with the bottom end of the tool 400. The landing cone 410 may also act as a baffle during descent to assist in slowing the velocity of the tool 400.

Figure 5:
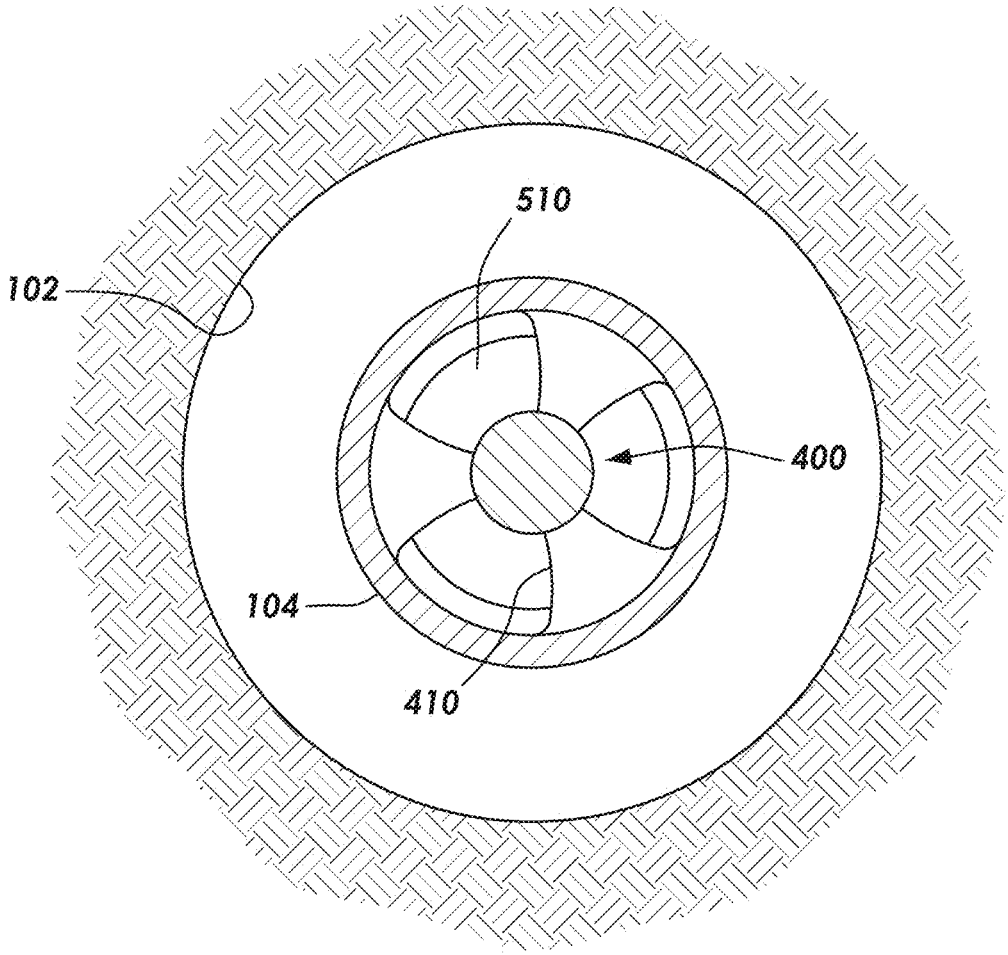
FIG. 5 is a cross-sectional view of the tool in the landing sub taken across line V-V of FIG. 4.

FIG. 5 shows the tool 400 in the landing sub 104 as viewed across line V-V of FIG. 4. Openings 510 extending through a length of the landing cone 410 allow fluid flow from above the landing cone 410 to below the landing cone 410. The landing cone 410 thus defines radial extensions from a central body of the tool 400 out toward the landing sub 104 due to the openings 510. While shown with three of the openings 510, other embodiments may use more or less of the openings 510 to balance between structural aspects of the landing cone 410 and restrictiveness of fluid flow across the landing cone 410.

Figure 6:
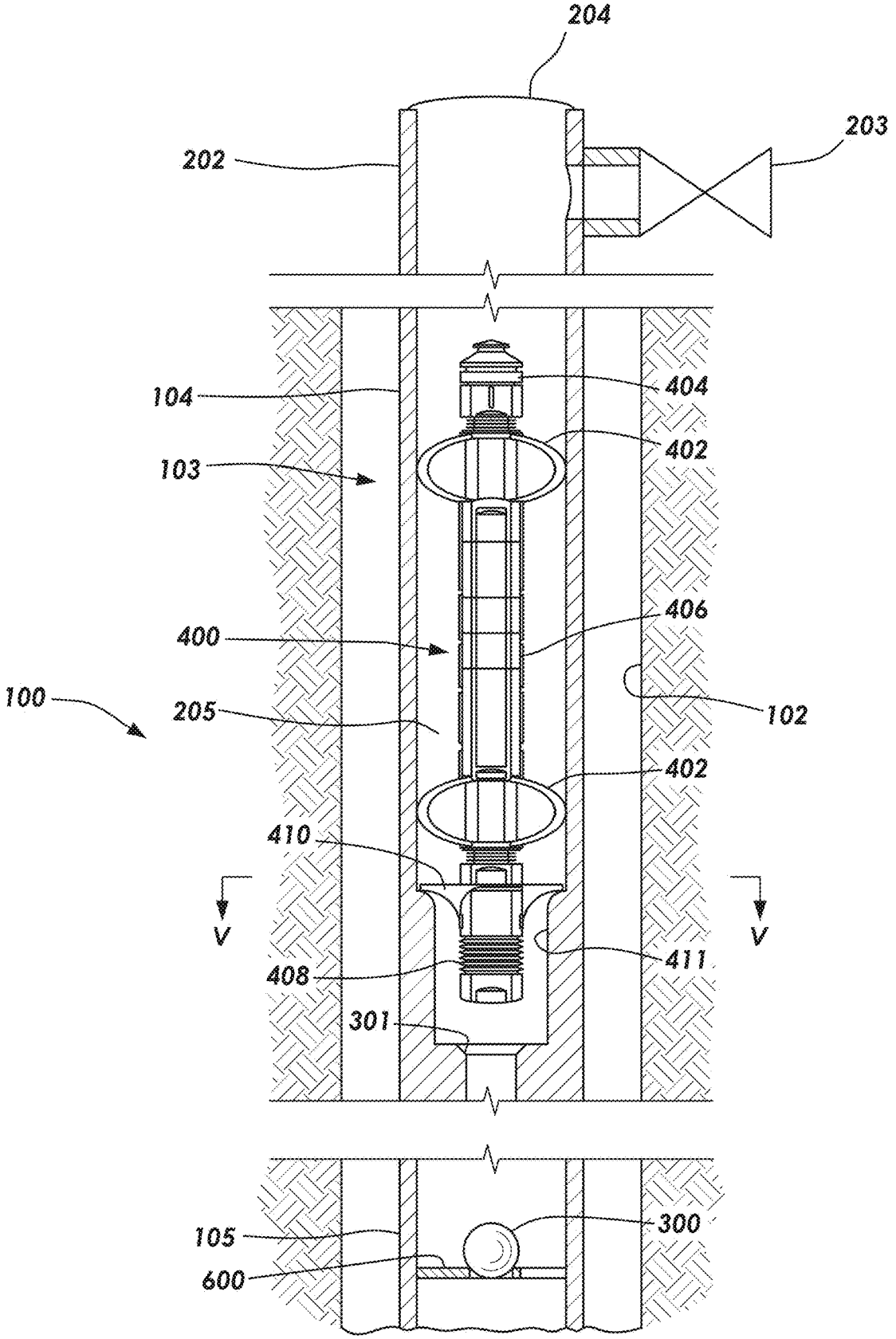
FIG. 6 is a partial cross-sectional view of the tool in the landing sub and the obstruction displaced to the catch sub to permit fluid exiting the drill string in a circulation restored state.

FIG. 6 illustrates the tool 400 in the landing sub 104 and the ball 300 displaced to the catch sub 105 to permit fluid exiting the drill string 103 in a circulation restored state. For some embodiments, displacing of the ball 300 from the seat 301 to the catch sub 105 occurs by closure of the bypass valve 203 to let the drilling fluid being pumped into the input end 204 of the surface sub 202 pressurize the interior area 205 in the landing sub 104 above the ball 300 to a higher pressure than the threshold pressure necessary for pushing the ball 300 through the seat 301. A baffle plate that may be disposed within a connection along the drill string 103 in some embodiments forms the catch sub 105. Other options for protrusions 600, like the baffle plate, into the inner diameter of the catch sub 105 may also block passage of the ball 300 while having sufficient open areas to allow fluid to pass around the ball 300. In the circulation restored state, the drilling fluid passes through the landing cone 410 of the tool 400 and around the ball 300 past the protrusions 600 without being blocked at either the landing sub 104 or the catch sub 105 along the drill string 103. The opened flow of the drilling fluid through the drill string 103 may facilitate further drilling of the wellbore 102, different downhole tasks where fluid is needed below the catch sub 105, hydrostatic wellbore control or draining of the drill string 103 prior to tripping of the drill string 103 to surface.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method of landing a tool downhole in a tool dropping operation, comprising:

running a tubular string into a wellbore, wherein the tubular string includes a seat defining a first restriction in an inner diameter of the tubular string and a landing profile defining a second restriction in the inner diameter of the tubular string above the seat;

dropping a plug into the tubular string and onto the seat to block fluid flow through the seat;

filling the tubular string above the plug on the seat with a liquid-based fluid; and passing the tool in the tool dropping operation through the fluid until an outward extending landing element of the tool is retained at the landing profile.

2. The method of claim 1, further comprising forcing the plug past the seat and catching the plug at a protrusion into the inner diameter of the tubular string below the seat, wherein the protrusion allows fluid flow through the tubular string from above the plug to below the plug.

3. The method of claim 1, wherein the tubular string is a drill string.

4. The method of claim 1, wherein the outward extending landing element of the tool is a landing cone tapering downward in a mating relationship to the landing profile.

5. The method of claim 1, wherein the outward extending landing element of the tool is a landing cone having openings through a length of the landing cone to allow fluid flow through the tubular string from above the landing cone to below the landing cone.

6. The method of claim 1, wherein the plug is a ball and the ball is pushed through the seat by increasing fluid pressure above the ball after the tool is caught at the landing profile.

7. The method of claim 1, further comprising logging the wellbore with the tool.

8. The method of claim 1, further comprising taking measurements with a gyro of the tool.

9. The method of claim 1, further comprising releasing the plug past the seat; catching the plug at a location in the tubular string below the seat; and establishing flow of the fluid from the tubular string above the location with the plug to out of the tubular string exiting below the location with the plug.

10. The method of claim 1, wherein the filling the tubular string with the fluid uses a surface sub having a bypass valve that opens during the filling at a threshold pressure to divert the fluid from flowing into the tubular string.

11. Tool deployment system for a tool dropping operation to land a tool downhole, comprising:

a tubular string disposed in a wellbore;

a seat defining a first restriction in an inner diameter of the tubular string;

a plug retainable by the seat to block fluid flow through the seat;

a landing profile defining a second restriction in the inner diameter of the tubular string above the seat;

an outward extending landing element of the tool for retention of the tool at the landing profile as the tool travels through the tubular string in the tool dropping operation; and a protrusion into the inner diameter of the tubular string below the seat, wherein the protrusion is configured to catch the plug and allow fluid flow through the tubular string from above the plug to below the plug.

12. Tool deployment system of claim 11, wherein the tubular is a drill string.

13. Tool deployment system of claim 11, wherein the outward extending landing element of the tool is a landing cone tapering downward in a mating relationship to the landing profile.

14. Tool deployment system of claim 11, wherein the outward extending landing element of the tool is a landing cone having openings through a length of the landing cone to allow fluid flow through the tubular string from above the landing cone to below the landing cone.

15. Tool deployment system of claim 11, wherein the plug is a ball selectively retained in the seat based on amount of fluid pressure above the ball.

16. Tool deployment system of claim 11, wherein the tool is a wellbore logging device.

17. Tool deployment system of claim 11, wherein the tool is a gyro.

18. A method of landing a measuring device downhole in a tool dropping operation, comprising:

drilling a wellbore with a drill string having a bit at a distal end of the drill string, wherein inside the drill string includes a seat and a landing profile above the seat;

dropping a ball onto the seat to block fluid flow past the seat;

filling the drill string above the ball on the seat with a liquid-based fluid;

passing the measuring device in the tool dropping operation through the fluid until a landing cone of the measuring device is caught at the landing profile;

logging the wellbore with the measuring device;

pushing the ball through the seat by increasing fluid pressure above the ball;

catching the ball at a location in the drill string above the bit after the ball is pushed through the seat; and establishing flow of the fluid from the drill string above the location with the ball to out of the drill string exiting below the location with the ball.

19. The method of claim 18, wherein the logging includes taking measurements with a gyro of the measuring device.

* * * * *